US006198493B1

(12) United States Patent
Kishimoto et al.

(10) Patent No.: US 6,198,493 B1
(45) Date of Patent: Mar. 6, 2001

(54) RECORDING APPARATUS

(75) Inventors: Mitsuru Kishimoto; Hideyuki Kobayashi; Noboru Ooishi; Kiyoshi Ikeda, all of Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/044,008

(22) Filed: Mar. 19, 1998

(30) Foreign Application Priority Data

Mar. 26, 1997 (JP) ..... 9-073199

(51) Int. Cl.[7] ..... B41J 2/315
(52) U.S. Cl. ..... 347/171; 347/9
(58) Field of Search ..... 347/171, 211, 347/9, 10, 11, 15, 65, 94; 358/198

(56) References Cited

U.S. PATENT DOCUMENTS 5,557,304 * 9/1996 Stortz ..... 347/15
5,604,526 * 2/1997 Kwak ..... 347/191
5,614,931 * 3/1997 Koike et al. ..... 347/43
5,689,291 * 11/1997 Tence et al. ..... 347/11
5,790,152 * 9/1998 Harrington ..... 347/48
5,907,331 * 5/1999 Markham ..... 347/12
5,917,510 * 6/1999 Narushima ..... 347/15

* cited by examiner

*Primary Examiner*—N. Le
*Assistant Examiner*—Shih-Wen Hsieh
(74) *Attorney, Agent, or Firm*—Rabin & Champagne, P.C.

(57) ABSTRACT

A dot data generator receives print data from a host apparatus and generates dot data from the print data. Dots have different diameters according to a gradation level. A drive frequency setting section sets a drive frequency in accordance with the print data. A drive signal generator generates a timing in timed relation with the drive frequency. A recording head is driven at the generated timing to form a plurality of dots on a print medium. An operation circuit determines a total drive time forming dots for each line in the main scanning direction. The drive frequency is set on a line-by-line basis in accordance with the total drive time. The timing may be delayed so that dots are formed always at accurate print positions irrespective of the scanning speed in the main scanning direction and in the sub scanning direction.

15 Claims, 17 Drawing Sheets

RECORDING APPARATUS

BACKGROUND OF THE INVENTION

1. Field of the Invention

The present invention relates to a recording apparatus such as an ink jet recording apparatus and a thermal transfer recording apparatus.

2. Description of Related Art

With conventional recording apparatus such as ink jet recording apparatus and thermal transfer recording apparatus, the diameters of a plurality of lots printed on a print medium are varied to provide gradation. For this purpose, the recording head is driven for different time lengths in accordance with print data to control sizes of ink drops ejected from the orifices or amounts of ink thermally transferred to the print medium.

For conventional ink jet recording apparatus, controlling the ink drop size alone cannot provide an adequate size ratio of a minimum dot to a maximum dot to provide a desired gradation. In order to overcome this drawback, acoustic vibration of the ink channel is utilized to eject more than one ink drop successively, which merge into a single large drop before landing on the print medium.

The aforementioned conventional recording apparatus use fixed drive frequencies. If the recording head is driven a longer time for a larger ink drop or driven more than one time for improved gradation, the overall printing time is longer. This leads to a lower printing speed.

SUMMARY OF THE INVENTION

An object of the present invention is to provide a recording apparatus which is driven at a high drive frequency to obtain an increased printing speed.

A recording apparatus comprises a lot data generator that generates dot data from print data and outputs the dot data. A drive frequency setting section sets a drive frequency in accordance with print data. A drive signal generator receives the drive frequency setting signal and generates a drive signal having drive times and timings for driving a recording head. The drive times change in accordance with the dot data and the timings are in timed relation with the drive frequency. The recording head is driven by the drive signal to form a plurality of dots on a print, medium. The dots have different diameters according to the drive time.

The recording apparatus further comprising a mode selector which selects a printing mode in accordance with a specified resolution of the print data. The drive frequency setting section sets the drive frequency in accordance with the selected printing mode.

The recording apparatus still includes an operation circuit which determines a total drive time for which the recording head is driven to form dots corresponding to the dot data. The operation circuit determines the total drive time on a line-by-line basis and the drive frequency setting section sets the drive frequency on a line-by-line basis.

The drive signal generator may give a delay to the timing, so that the ink drops land on predetermined locations on the print medium 44 even when the drive frequency varies from line to line.

The recording head includes a first channel holding a more frequently used ink therein and a second channel holding a less frequently used ink therein. The first channel has a longer channel length than the second channel. The drive frequency setting section sets a higher drive frequency for the channel holding the more frequently used ink.

An adjacent dot detector determines whether adjacent dots in the dot data are of different colors. If the adjacent dots are of different colors, a gradation comparator determines whether a gradation level of one of the colors is higher than a predetermined setting.

A gradation converter converts gradation levels higher than the predetermined setting to a lower gradation level and the drive frequency setting section sets the drive frequency in accordance with the conversion of gradation.

The recording apparatus includes a speed setting section which sets a scanning speed of the recording head in a main scanning direction. Another second setting section sets a scanning speed of the recording head in a sub scanning direction. These scanning speeds are determined in accordance with the timing.

Further scope of applicability of the present invention will become apparent from the detailed description given hereinafter. However, it should be understood that the detailed description and specific examples, while indicting preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described in detail with reference to the accompanying drawings.

First Embodiment

Figure 1:
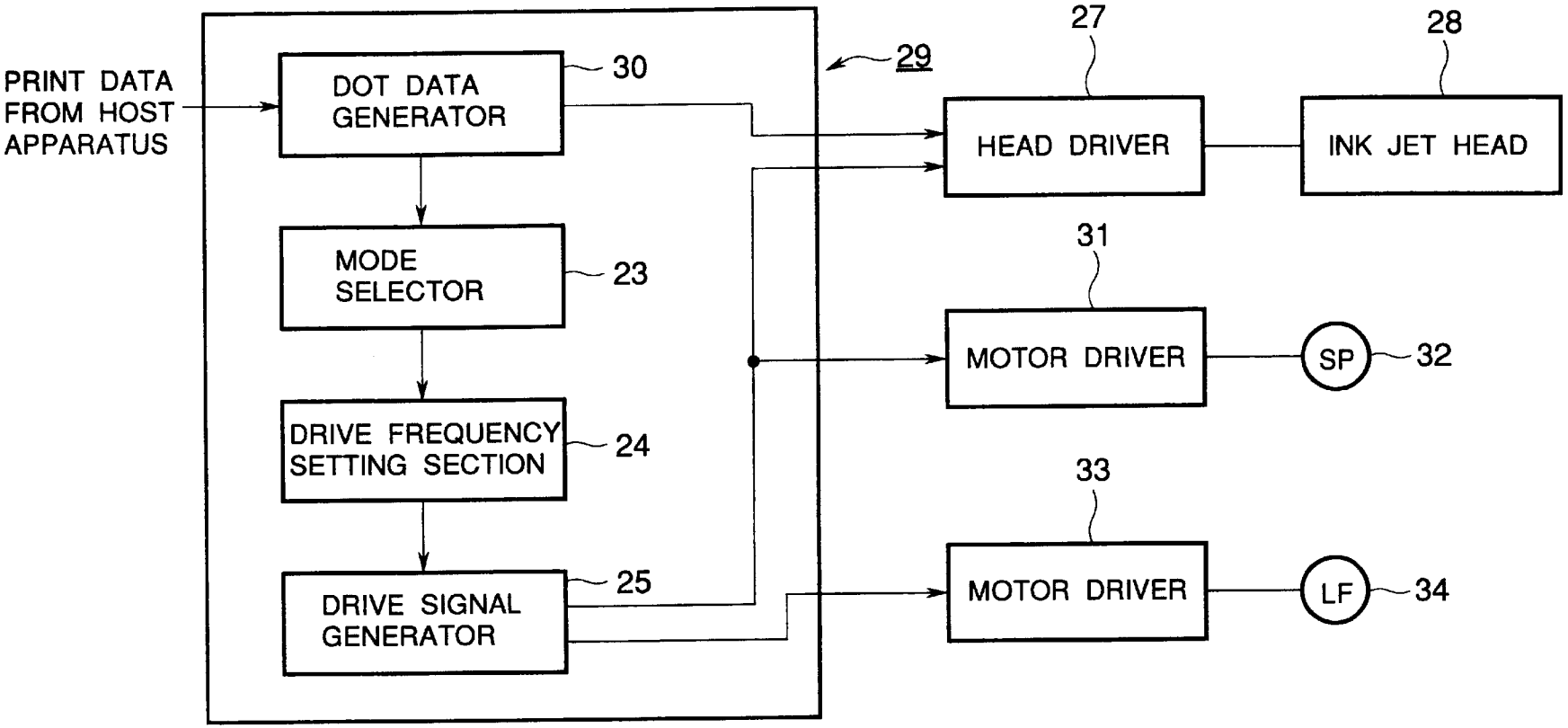
FIG. 1 is a block diagram of a control system for an ink jet recording apparatus of a first embodiment.

FIG. 1 is a block diagram of a control system for an ink jet recording apparatus of a first embodiment.

Referring to FIG. 1, a controller 29 controls the printing operation of the ink jet recording apparatus. A dot data generator 30 receives print data from a host apparatus, not shown, and generates dot data from the received print data. The dot data generator 30 also generates a printing mode specifying signal from a command received from the host apparatus. A mode selector 23 receives the printing mode specifying signal from the dot data generator 30 and generates a mode signal for selecting either a low-resolution mode or a high-resolution mode. In the low-resolution mode, images such as characters and symbols are printed at a resolution of 300 dpi. In the high-resolution mode, images such as photographs are printed at a resolution of 600 dpi.

A drive frequency setting section 24 receives the mode signal and sets a drive frequency for a resolution specified by the mode signal. From the drive frequency, a drive signal generator 25 generates a drive signal having drive times and timings for driving a color ink jet head 28. The drive times are in accordance with the dot data and determine the sizes of dots to be printed on a print medium. A head driver 27 generates drive voltages in accordance with the drive signal to drive the color ink jet head 28. A motor driver 31 sets a scan speed in a main scanning direction in accordance with the timings, and controls a spacing motor 32 to the specified scan speed. A motor 33 sets a scan speed in a sub-scanning direction in accordance with the timings and controls a line feed motor 34 to the specified scan speed. The spacing motor 32 moves the ink jet head 28 back and forth across a print medium, not shown, in the main scanning direction while the line feed motor 34 causes the print medium to advance in the sub-scanning direction. The color ink jet head 28 is capable of forming a plurality of dots on the print medium, the dots having different diameters in accordance with the drive times in the drive signal. In the first embodiment, a monochrome ink jet head may be used in place of the color ink jet head 28.

The mode selector 23 may be designed to select the print mode in accordance with a command which is input from an operating panel, not shown.

Figure 2:
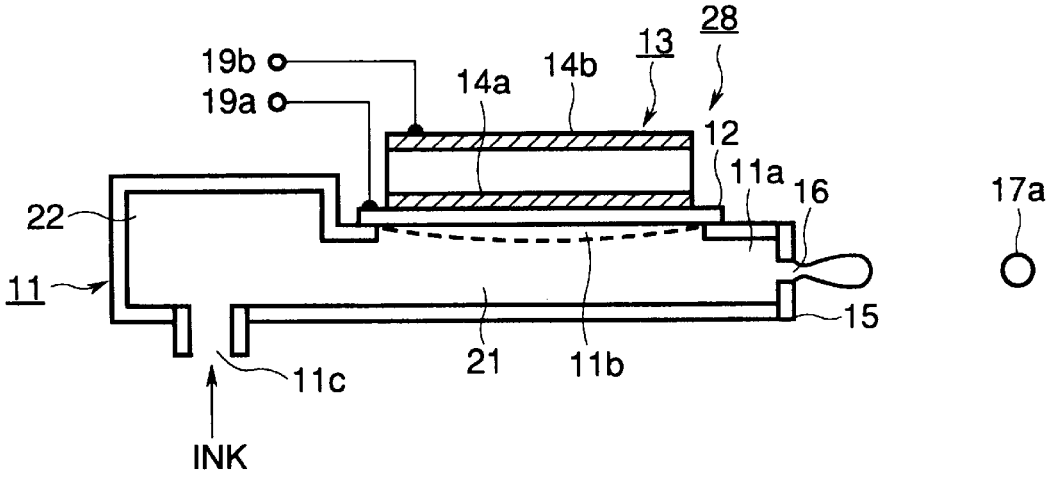
FIG. 2 illustrates an ink jet head ejecting a small ink drop.

FIG. 2 illustrates an ink jet head 28 ejecting a small ink drop 17*a*.

Figure 3:
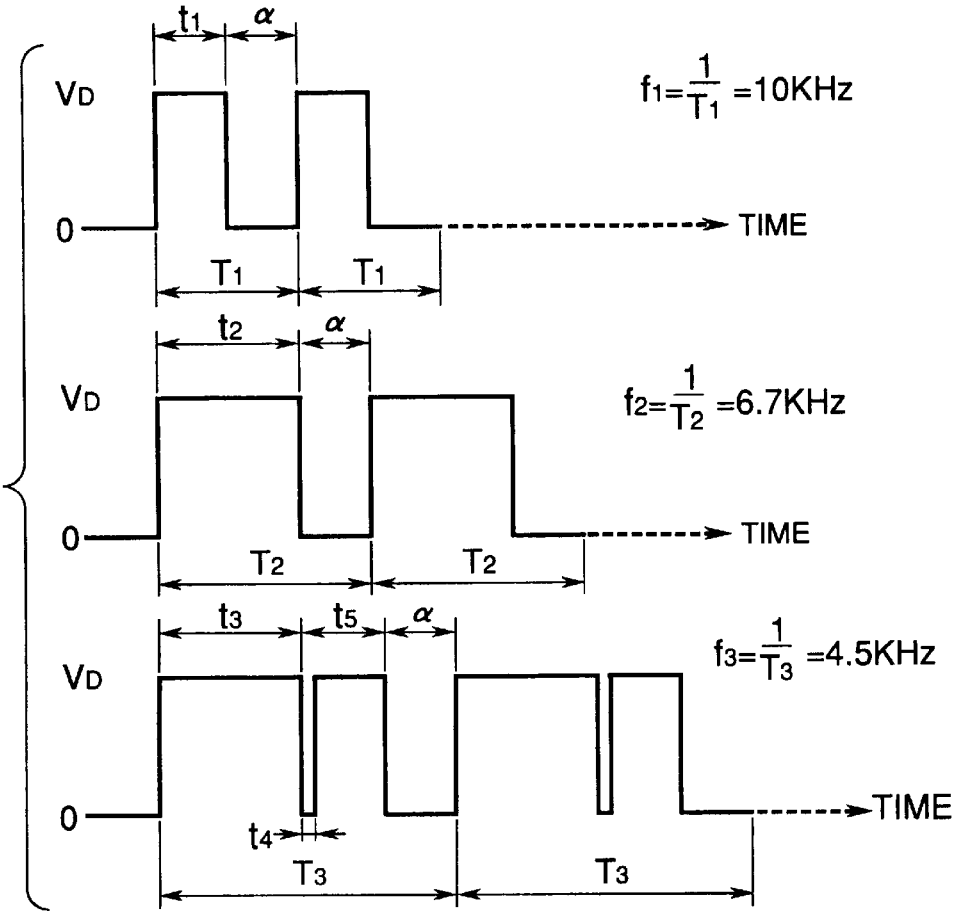
FIG. 3 is a timing chart for the operation shown in FIGS. 2, 4, and 5.
Figure 4:
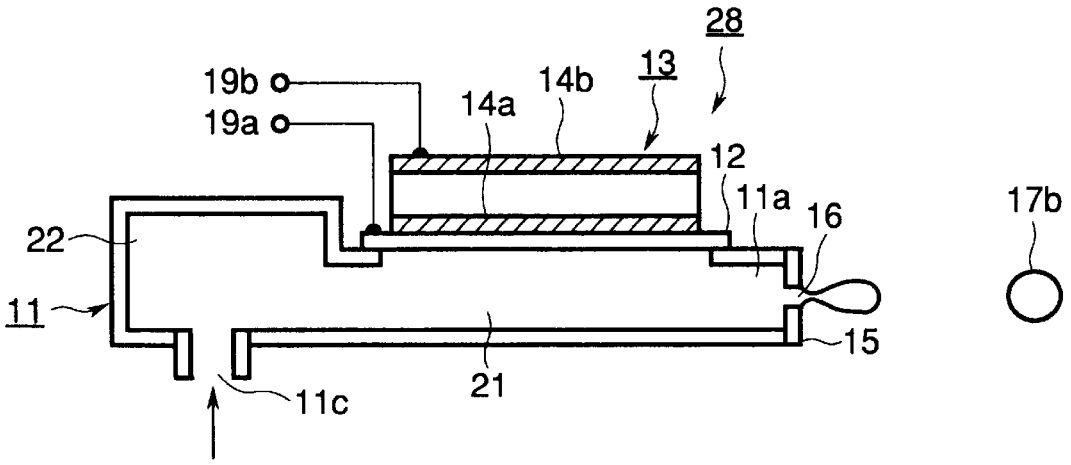
FIG. 4 illustrates the ink head ejecting a large ink drop.
Figure 5:
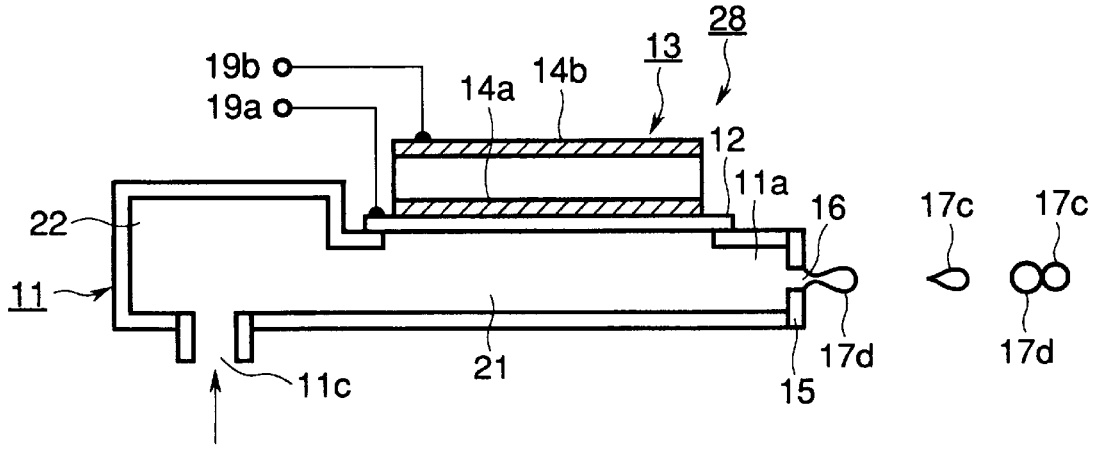
FIG. 5 illustrates the ink jet head ejecting a plurality of ink drops in succession.

FIG. 3 is a timing chart for the operations shown in FIGS. 2, 4, and 5.

FIG. 4 illustrates the ink jet, head 28 ejecting a large ink drop.

FIG. 5 illustrates the ink jet head 28 ejecting a plurality of ink drops 17*c* and 17*d* in succession.

Figure 6:
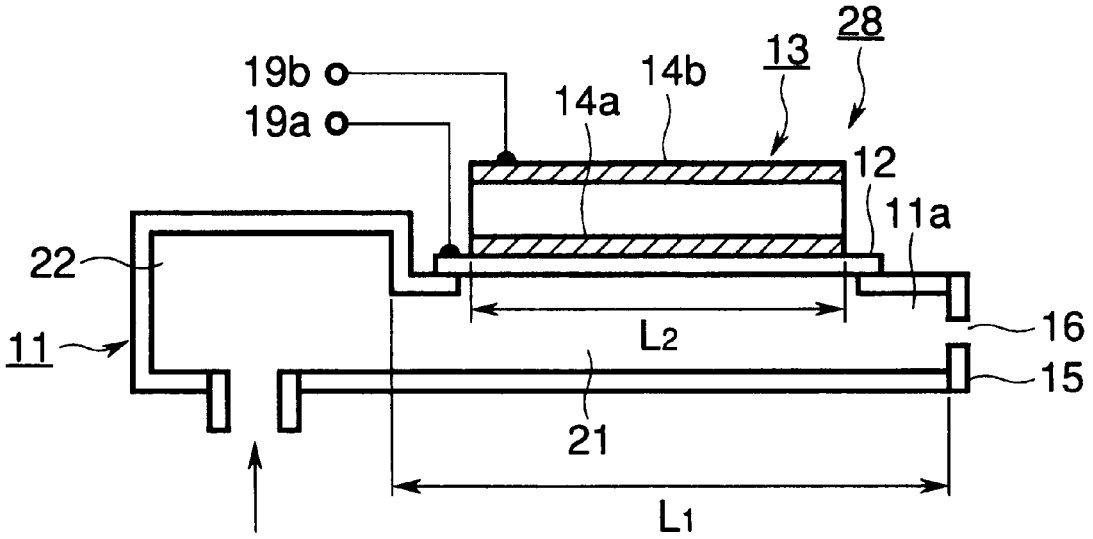
FIG. 6 illustrates the ink head of the first embodiment in its inoperative state.

FIG. 6 illustrates the ink jet head 28 of the first embodiment in its inoperative state.

Figure 7:
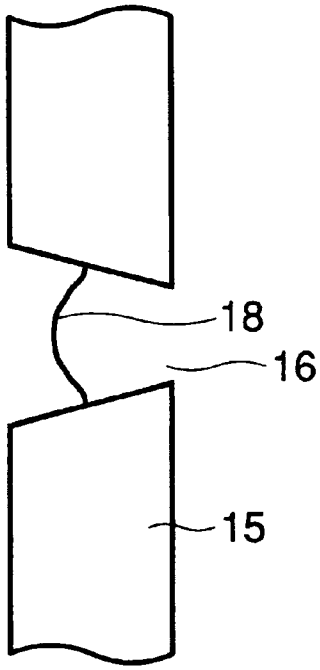
FIG. 7 is an enlarged view of a relevant portion of FIG. 6.

FIG. 7 is an enlarged view of a relevant portion of FIG. 6.

Referring to FIG. 2, a housing 11 has a plurality of channels 21. Each channel 21 has a first opening 11*a* at a front thereof (right ends in FIGS. 2, 4, 5, and 6), a second opening 11*b* on a top thereof, and a third opening 11*c* at a bottom thereof. The first, opening 11*a* is closed by an orifice plate 15 and the second opening 11*b* is closed by a diaphragm 12. The diaphragm 12 has a piezoelectric element 13 sandwiched between electrodes 14*a* and 14*b*. A predetermined drive voltage $V_D$ is applied across the electrodes 14*a* and 14*b* for a predetermined time length, so that the piezoelectric element 1:3 is driven to deform the diaphragm 12. The deformed diaphragm 12 imposes a pressure oil the ink in the ink channel 21. The drive voltage $V_D$ is fed via terminals 19*a* and 19*b*.

Each orifice plate 15 is formed with orifices 16 therein. When the ink in the channel 21 is pressurized, ink drops are ejected through the orifices 16 to form dots on a print medium, not shown. The third opening 11*c* communicates with an ink tank, not shown, so that the ink from the ink tank is introduced through the third opening 11*c* into a common ink chamber 22.

The operation of the ink jet head 28 will now be described.

As shown in FIG. 3, when the drive voltage $V_D$ is applied across the electrodes 14*a* and 14*b* for a minimum drive time t1 via the terminals 19*a* and 19*b*, the piezoelectric element 13 causes the diaphragm 12 to deform as depicted by a dotted line in FIG. 2. Thus, the ink in the channel 21 is pressurized and an ink drop having a minimum size is ejected through the orifice 16 to form a dot having a diameter d1 on the print medium.

When the drive voltage $V_D$ is applied across the electrodes 14*a* and 14*b* for a maximum time length t2, an ink drop 17*b* having a maximum size is ejected through the orifice 16 shown in FIG. 4. The ink drop 17*b* lands onto the print medium to form a dot having a diameter d2 larger than a diameter d1.

When a still larger dot having a diameter d3 is needed, the piezoelectric element 13 is driven more than one time for a short time length using acoustic vibration of the ink. For example, the drive voltage $V_D$ is applied for a time length t3, then after a short time length t4, again applied for a time length t5. Thus, the ink drops 17*c* and 17*d* are ejected in succession as shown in FIG. 5, the second driving (i.e., t5) of the piezoelectric element 13 being in timed relation with the acoustic vibration of ink. In other words, the second ejection is effected just when a meniscus 18 extends in an ejection direction, so that the second ink drop 17*d* is ejected at a higher speed than the first ink drop 17*c*. As a result, the ink drops 17*c* and 17*d* merge into a single drop before they land on the print medium, thereby forming a dot having a diameter d3 larger than d2.

Then, the drive voltage $V_D$ is removed so that the ink jet head 28 is in an inoperative state as shown in FIG. 6, and the meniscus 18 is formed in the orifice 16 as shown in FIG. 7.

If the channel 21 has a length L1 and the piezoelectric element 13 has a length L2, the length L1 determines the frequency of acoustic vibration.

The acoustic resonance frequency of the channel 21 increases with decreasing the length L1, allowing driving of the ink jet head 28 at higher speeds. However, the length L2 becomes shorter with decreasing length L1 so that the pressure applied to the ink in the channel 21 decreases and ink drops become smaller correspondingly.

A method of driving an ink jet head is referred to as "single-drop method" if a single ink drop, as shown in FIGS. 2 and 4, is ejected from the channel to form a single dot. A method of driving an ink jet head is referred to as "double-drop method" if ink drops are ejected from the channel 21 as shown in FIG. 5 to form a single dot.

Figure 8:
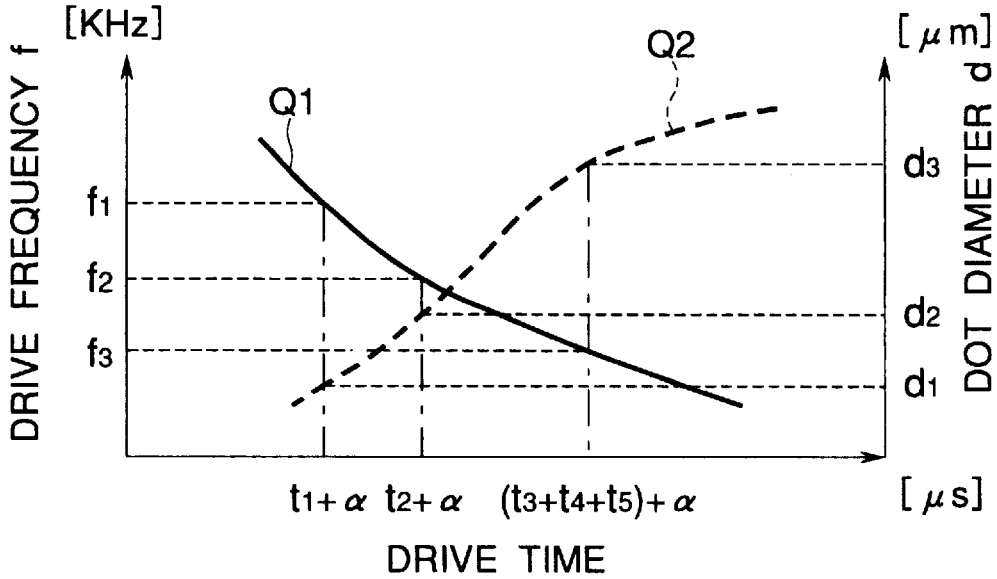
FIG. 8 illustrates the relation among drive time, dot diameter, and drive frequency.

FIG. 8 illustrates the relationship among drive times, diameters of dots, and drive frequencies. FIG. 8 plots the drive time of the piezoelectric element 13 as the abscissa and drive frequency and the diameter of dot as the ordinate.

Referring to FIG. 8, Curve Q1 shows the relationship between the drive frequency and the drive time length of the piezoelectric element 13, and Curve Q2 shows the relationship between the dot diameter and the drive time length of the piezoelectric element 13.

For example, driving the piezoelectric element 13 for a minimum drive time length t1 results in a dot diameter d1 which assumes a drive frequency f1. Similarly, driving the piezoelectric element 13 for a maximum drive time length t2 results in a dot diameter d2 which assumes a drive frequency f2. Driving the piezoelectric element 13 for successive drive time lengths t3 and t5 results in a dot diameter d3 which assumes a drive frequency f3. Time a is a time required for the pressure of the ink in the channel 21 to decay after the piezoelectric element 13 is driven. Thus, the time required for ejecting one ink drop is drive time length plus time $\alpha$. The dot diameters d1 and d2 are formed by the single-drop method while the dot diameter d3 is formed by the double-drop method.

Error example, if t1=50 $\mu$s t2=100 $\mu$s t3=100 $\mu$s t4=10$\mu$s t5=60 $\mu$s $\alpha$=50 $\mu$s, then d1=30 $\mu$m d2=60 $\mu$m d3=100 $\mu$m $f1=1/(t1+\alpha$
$=\{1/(50+50)\}\times10^6=10.0$ kHz $f2=1/(t2+\alpha)$
$=\{1/(100+50)\}\times10^6$
=6.7 kHz $f3=1/(t3+t4+t5+\alpha)$
$=\{1/(100+10+60+50)\}\times10^6$
=4.5 kHz Therefore, if the drive frequency is set to the drive frequency f3 (=4.5 kHz) by the drive frequency setting section 24 (FIG. 1), the ink jet head 28 can perform a printing with gradation using dots in the range of 30–100 $\mu$m, which dots can be formed by selecting the drive time in the range from t1 to t3+t4+t5.

With the conventional ink jet recording apparatus, when a printing is performed at a resolution of 600 dpi, the ink jet head 28 must be moved at reduced speeds in the main seanning and sub-scanning directions, the speeds being halves of those when a printing operation is performed at a resolution of 300 dpi. Thus, the overall printing speed for 600 dpi becomes one-fourth that for 300 dpi. for example, if the printing speed of the conventional ink jet recording apparatus is 4 PPM (page per minute) when a printing is performed at a resolution of 300 dpi, then the printing speed becomes 1 PPM when a printing is performed at a resolution of 600 dpi.

In the first embodiment, dot diameters are directly determined by a desired resolution (300 dpi or 600 dpi). Thus, the drive time length and drive method are selected according to the dot diameter which automatically assumes a drive frequency.

Figure 9:
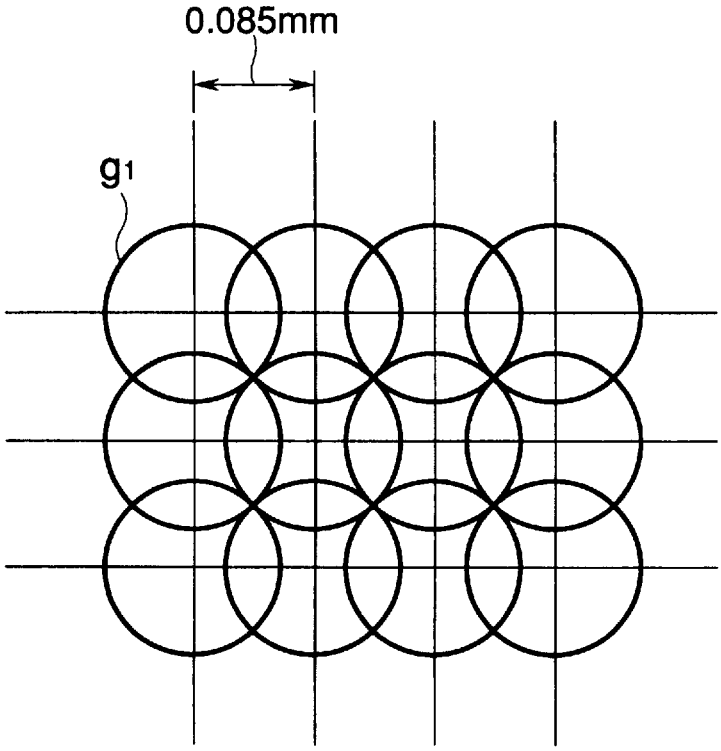
FIG. 9 illustrates an example of a dot matrix when printing is performed in a low-resolution mode.

FIG. 9 illustrates an example of a dot matrix when a printing is performed in a low-resolution mode.

Denoted by g1 are dots formed on the print medium with a 300 dpi resolution. The dots g1 have diameters in the range from 90 to 120 $\mu$m and are formed at intervals of 0.085 mm.

Figure 10:
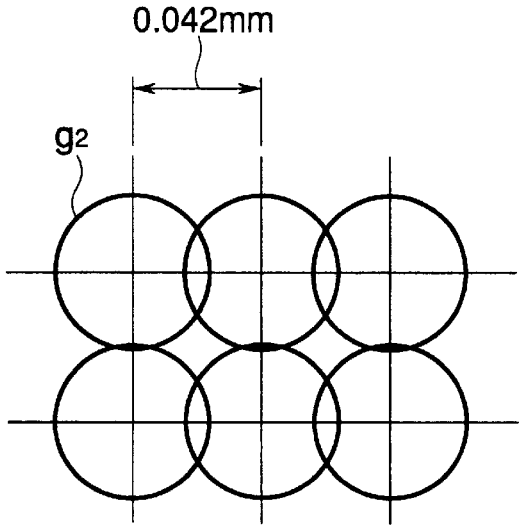
FIG. 10 illustrates an example of a dot matrix when printing is performed in a high-resolution mode.

FIG. 10 illustrates an example of a dot matrix when a printing is performed in a high-resolution mode. Denoted by g2 are dots formed on the print medium with a 600 dpi resolution. The dots g2 have diameters in the range from 50 to 70 $\mu$m and are formed at intervals of 0.042 mm.

Thus, when printing with a 300 dpi resolution, the head driver 27 (FIG. 1) controls the drive time length of the head 28 such that the ink jet head 28 is driven at a drive frequency of f3 (=4.5 kHz) to form dots having the dot diameter to d3 (=100 $\mu$m). Similarly, when printing with a 600 dpi resolution, the head driver 27 controls the drive time length of the head 28 such that the ink jet head 28 is driven at a drive frequency of f2 (=6.7 kHz) lo form dots having the dot diameter to d2 (=60 $\mu$m).

As noted above, the drive frequency for the 600 dpi resolution is about 1.5 times (6.7 kHz/4.5 kHz=1.488) that for the 300 dpi, and accordingly the printing speed is 1.5 PPM, i.e., 1.5 times faster than the conventional ink jet recording apparatus where a single drive frequency is used for both the 600 dpi resolution and 300 dpi resolution.

As mentioned above, the dot diameter is changed in accordance with a desired resolution and the drive frequency is changed correspondingly. When printing in the high-resolution mode, a higher drive frequency is selected which allows a high speed printing.

Second Embodiment

A second embodiment has the same control system as the first embodiment shown in FIG. 1.

Figure 11:
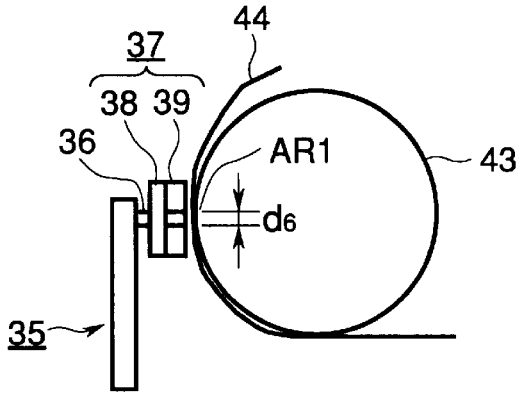
FIG. 11 shows a thermal head in a first state.
Figure 12:
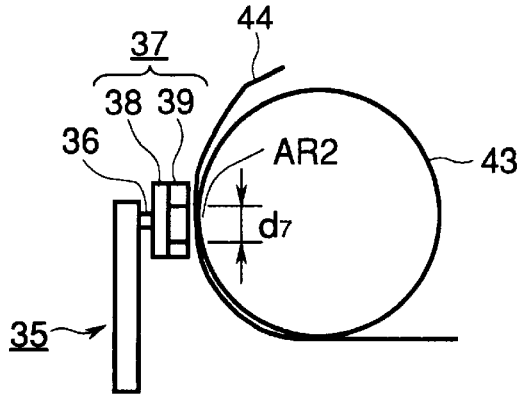
FIG. 12 shows a thermal head in a second state.
Figure 13:
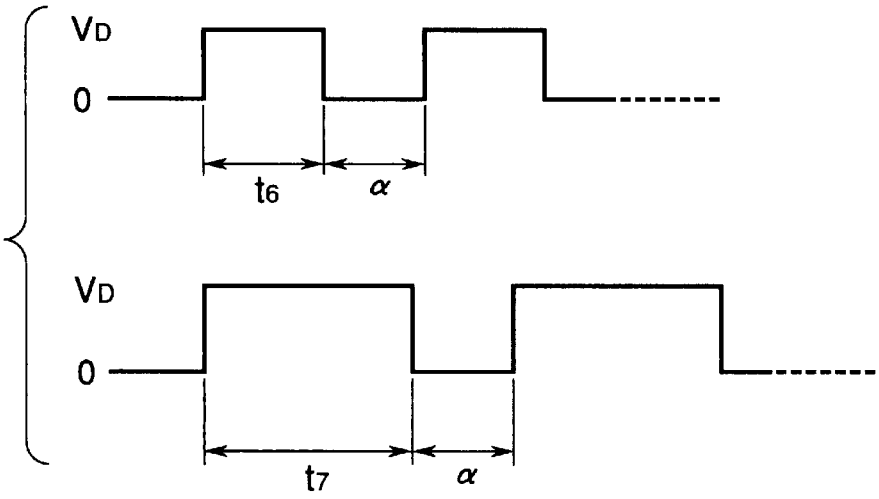
FIG. 13 is a timing chart in accordance with a second embodiment.

FIG. 11 shows a thermal head in a first state of a second embodiment and FIG. 12 shows the thermal head in a second state. FIG. 13 is a timing chart for the first and second states.

Referring to FIG. 11, a thermal head 35 has a plurality of resistors 36 and is capable of forming a plurality of dots having different diameters on the print medium 44. An ink ribbon 37 has a base 38 on which heat-melted inks 39 is applied. A platen is depicted at 43.

When the thermal head 35 is driven by a voltage $V_D$ applied across a resistor 36 for a drive time length t6 as shown in FIG. 13 in accordance with the print data, an amount of heat is generated in the resistor 36. This heat causes an area AR1 of the ink 39 opposing the energized resistor 36 to melt, so that the melted ink is transferred to the print medium 44 to form a dot having a diameter d6 on the print medium 44 as shown in FIG. 13.

When the thermal head 35 is driven by a voltage $V_D$ applied across the resistor 36 for a time length t7 as shown in FIG. 13 in accordance with the print data, an amount of heat is generated in the resistor 36 and causes an area AR2 of the ink 39 opposing the resistor 36 to melt. The melted area AR2 is transferred to the print medium 44 to form a dot having a diameter d7 on the print medium 44.

In the second embodiment, too, the dot, diameter is selected in accordance with the gradation level of print data and the drive frequency is changed correspondingly. Thus, when printing in the high-resolution mode, a higher drive frequency is used which allows a high speed printing. It is to be noted that increasing the drive frequency increases the printing speed in the high-resolution mode.

Although the heat generated in the resistor 36 is used to transfer the areas AR1 and AR2 of the ink 39 onto the print medium, the same heat may also be used to heat thermally sensitive paper for color generation if such a print medium is used.

The idea that a drive time is shortened for an increased printing speed may find its application in an electrophotographic recording apparatus. Specifically, LEDs of an LED head used in the eletrophotographic recording apparatus may be energized for a shorter time so as to increase a printing speed.

Third Embodiment

Figure 14:
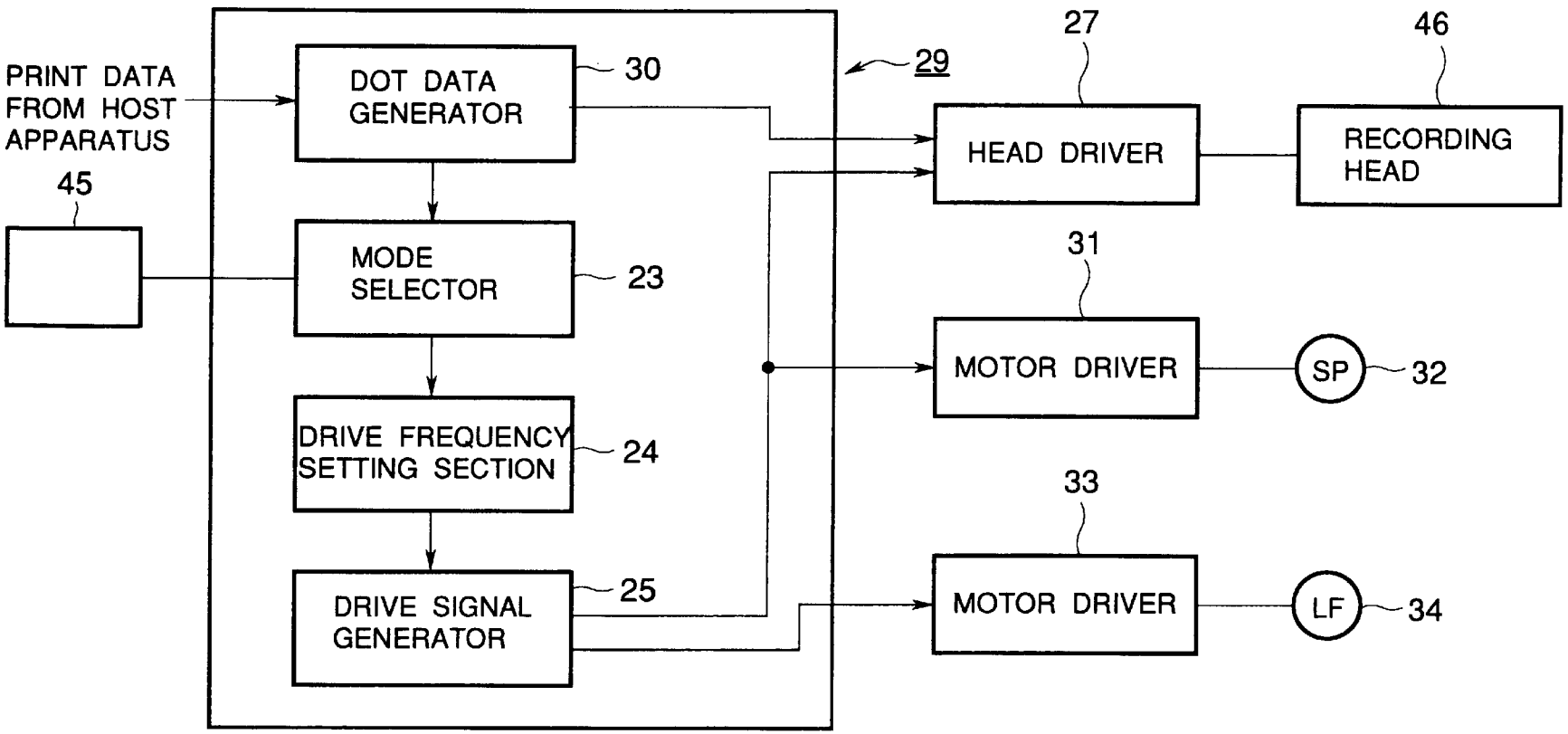
FIG. 14 is a block diagram of a controller for a recording apparatus according to a third embodiment.

FIG. 14 is a block diagram of a controller 29 for a recording apparatus according to a third embodiment. The same reference numerals have been given to elements similar to those in the first embodiment.

In the third embodiment, a print mode selector switch 45 is connected to the print mode selector 23. Operating the print mode selector switch 45 allows selection between a normal speed mode and a high speed mode.

For example, when the normal speed mode is selected, the recording head 46 (e.g., ink jet head 28) is driven at a drive frequency of f3 (=4.5 kHz) to form a dot diameter of (13 (=100 $\mu$m).

When the high speed mode is selected, the recording head 46 is driven at a drive frequency of f2 (=6.7 kHz) to form a dot diameter of d2 (=60 $\mu$m).

In the third embodiment, the resolution is 300 dpi both in the normal speed mode and in the high speed mode. Thus, in the high speed mode, dots are less closely located with decreasing dot diameter. However, the drive frequency in the high speed mode is about 1.5 times (6.7 kHz/4.5 kHz=1.48) that in the normal speed mode and therefore the printing speed is 1.5 PPM, which is 1.5 times higher than 1 PPM.

A recording head 46 may take the form of an ink jet head 28 (as shown in FIG. 1) or a thermal head 35 (as shown FIG. 11). For an electrophotographic recording apparatus, the recording head 40 may take the form of an LED head, in which case, the motor driver 31 and spacing motor 32 are not required.

Fourth Embodiment

Figure 15:
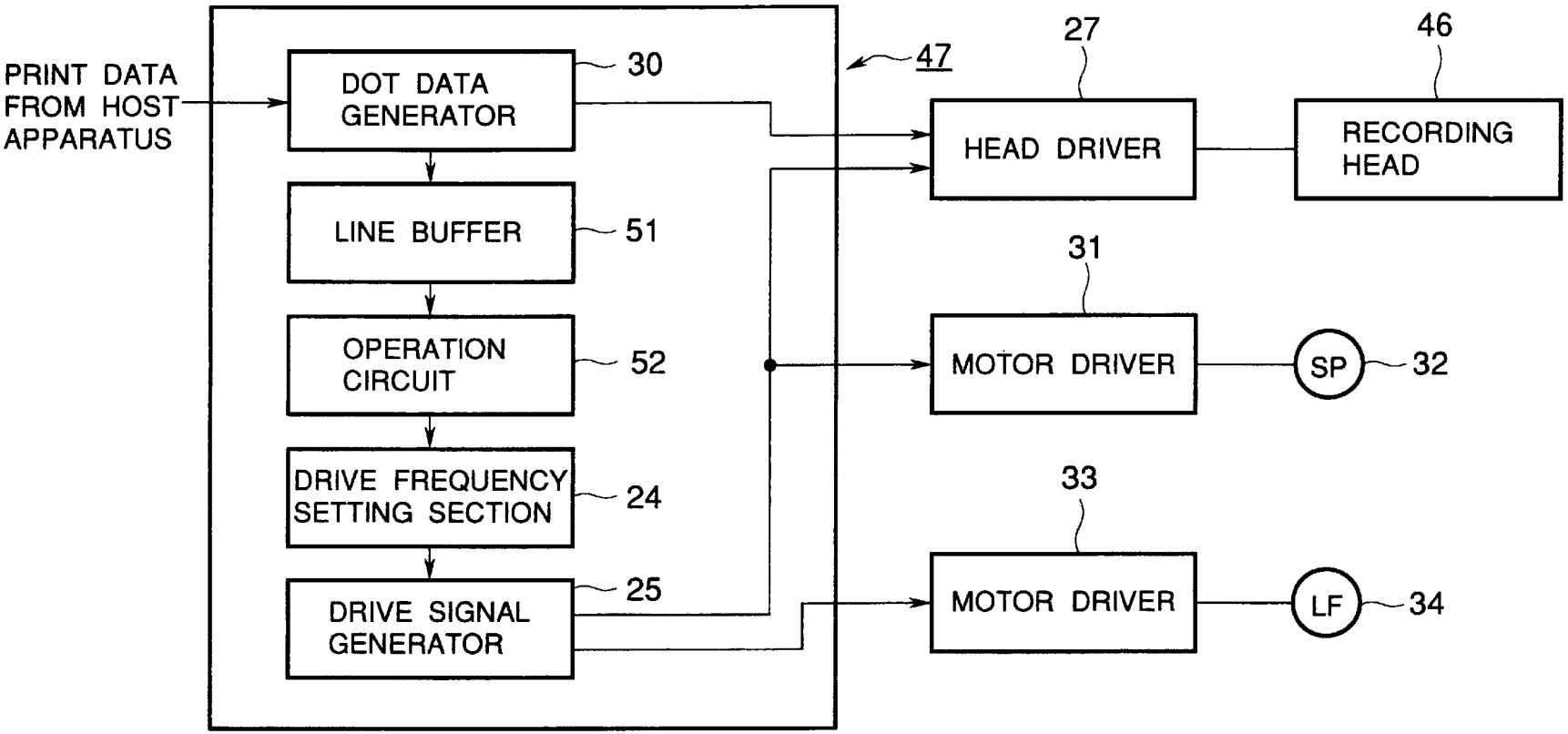
FIG. 15 is a block diagram of a controller of a recording apparatus according to a fourth embodiment.

FIG. 15 is a block diagram of a controller of a recording apparatus according to a fourth embodiment.

Referring to FIG. 15, a controller 47 controls the printing operation of the recording apparatus. A dot data generator 30 receives print data from a host apparatus, not shown, and generates dot data from the print data. A line buffer 51 receives dot data for one line from the dot data generator 30. An operation circuit 52 performs an operation on the dot data stored in the line buffer 51. A drive frequency setting section 24 determines a drive frequency in accordance with the output of the operation circuit 52, and outputs a frequency setting signal to a drive signal generator 25. The drive signal generator 25 generates a drive signal having drive times and timings. The timings are in timed relation with the drive frequency. The drive times are in accordance with the dot data and determine the sizes of dots to be printed on a print medium.

Figure 16:
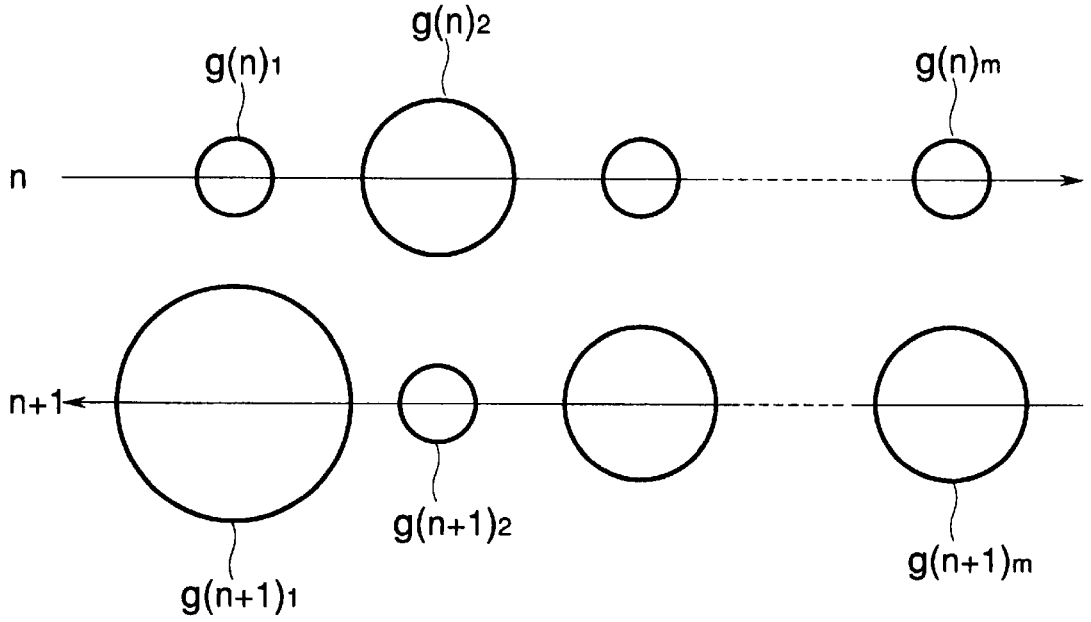
FIG. 16 is a diagram showing an example of a dot matrix of the fourth embodiment.

In the fourth embodiment, the recording head 46 performs a printing operation with gradation. Thus, the dot data generator 30 generates dot data having gradation data. FIG. 16 is a diagram showing an example of a dot matrix of the fourth embodiment. Referring to FIG. 16, arrows indicate the main scanning direction of the recording head 46 (FIG. 15). The same reference numerals have been given to elements similar to those in the first embodiment.

In the fourth embodiment, a dot in the n-th line is denoted by $g(n)_i$ where i=1, 2, . . . , m, and a dot in the (n+1)-th Line is denoted by $g(n+1)_i$ where i=1, 2, . . . , m. Dot diameters of the dots $g(n)_i$ and $g(n+1)_i$ are expressed by $d(n)_i$ and $d(n+1)_i$, respectively, where i=1, 2, . . . , m, respectively.

Drive times for the dots $g(n)_i$ and $g(n+1)_i$ are expressed by $t(n)_i$ and $t(n+1)_i$, respectively, where i=1, 2, . . . , m.

When dot data for the n-th line has been stored in the line buffer 51, the operation circuit 52 performs operations to generate a drive time $t(n)_i$ corresponding to a dot diameter $d(n)_i$ for each dot $g(n)_i$, and a total drive time T(n) required for printing the n-th line.

Then, the operation circuit 52 checks the total drive time T(n) to determine whether the total drive time T(n) is longer than a reference $T_{REF}$.

If $T(n)>T_{REF}$, then the operation circuit 52 sends the frequency setting signal indicative of a high frequency to the drive signal generator 25 which in turn increases the printing speed correspondingly.

Likewise, when dot data for the (n+1)-th line has been stored in the buffer 51, the operation circuit 52 performs operations to generate a drive time $t(n+1)_i$ corresponding to a dot diameter $d(n+1)_i$ for each dot g(n+1), and a total drive time T(n+1) required for printing the (n+1)-th line.

The operation circuit 52 checks the total drive time T(n+1) to determine whether the total drive time T(n+1) is longer than the reference $T_{REF}$. If $T(n+1)>T_{REF}$, the operation circuit 52 sends the frequency setting signal indicative of a high frequency to the drive signal generator 25 which in turn increases the printing speed correspondingly. In other words, the drive frequency is set on a line-by-line basis.

Dots in the n-th line show a case where the dot diameter $d(n)_i$ of a dot $g(n)_i$ in the n-th line is in the range of 30–60 $\mu$m and the drive frequency is set to f2(=6.7 kHz). Likewise, dots in the (n+1)-th line show a case where the dot diameter $d(n+1)_i$ of a dot $g(n+1)_i$ in the (n+1)-th line ranges from 30 to 100 $\mu$m and the drive frequency is set; to f3(=4.5 kHz).

As mentioned above, if the total drive time for each line is long, the drive frequency is increased for a higher printing speed.

If, for example, the recording head 46 takes the form of the color ink jet head 28 (as shown in FIG. 1), the dot data generator 30 generates dot data for each color. Accordingly, the operation circuit 52 determines the total drive times for dot data of all colors.

Fifth Embodiment

Figure 17:
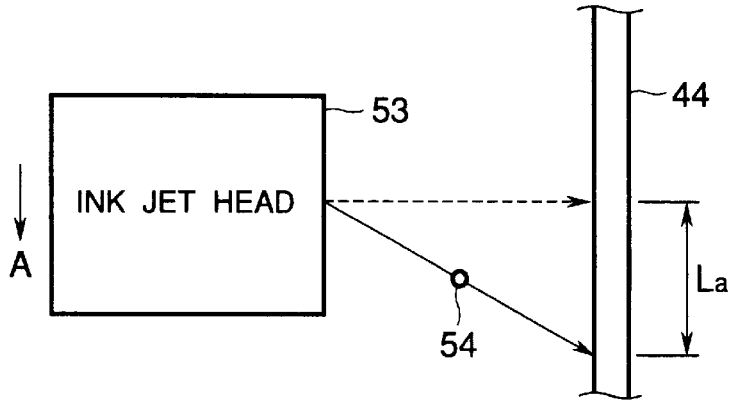
FIG. 17 illustrates a printing operation of an ink jet recording apparatus according to a fifth embodiment.
Figure 18:
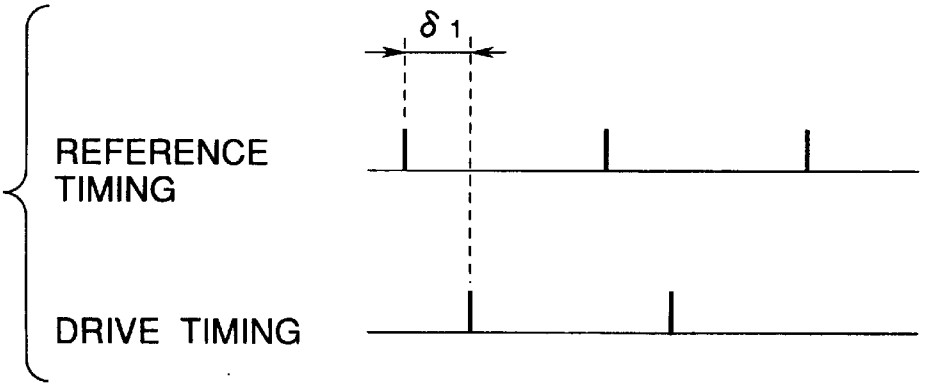
FIGS. 18 and 19 are timing charts.
Figure 19:
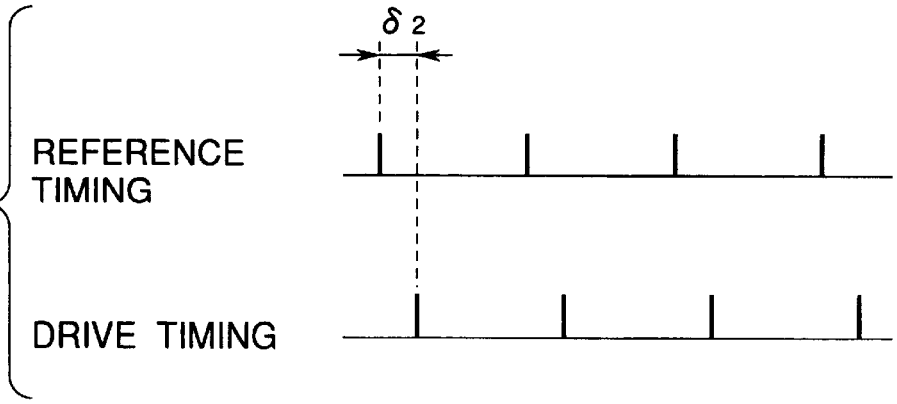

A fifth embodiment has the same control system as the fourth embodiment shown in FIG. 15. FIG. 17 illustrates a printing operation of an ink jet recording apparatus of a fifth embodiment. FIGS. 18 and 19 are timing charts. The same reference numerals have been given to elements similar to those in the fourth embodiment.

In the fifth embodiment, the drive frequency is set on a line-by-line basis just as in the fourth embodiment. If the recording head 46 (FIG. 18) takes the form of an ink jet head 53, a change in drive frequency causes a change in the speed of the spacing motor 32. As a result, the speed of a carriage, not shown, on which the ink jet head 53 is carried will also change.

In other words, when the ink jet head 53 is moving in a direction shown by arrow A (FIG. 17), the ink jet head 53 travels a distance La after ejection of an ink drop 54 till the ink drop 54 lands on the print medium 44. The distance La changes with changes in drive frequency and carriage speed. Thus, if the drive frequency is changed from line to line, then the print position on the print medium 44 on which the ink drop 54 lands varies from line to line. This impairs the print quality.

Thus, in order that the ink drop 54 lands on predetermined locations on the print medium 44 even when the drive frequency varies from line to line, the ink drops 54 should be ejected at different timings corresponding to the drive frequencies. Thus, the drive signal generator 25 generates reference timings which is a theoretical timing value, and drive timings which are actual timing values for driving the piezoelectric element 13 (FIG. 2).

For example, as shown in FIG. 18, if the drive frequency is low, the drive signal generator 25 outputs drive timings which have been delayed with respect to the reference timings by a delay time δ1. As shown in FIG. 19, if the drive frequency is high, the drive signal generator 25 outputs drive timings which have been delayed with respect to the reference timing by a delay time δ2. The delay time δ2 is shorter than the delay time δ1

Sixth Embodiment

A sixth embodiment is directed to all ink jet head having different channel lengths depending on colors. The sixth embodiment has the same control system as the first embodiment shown in FIG. 1.

Figure 20:
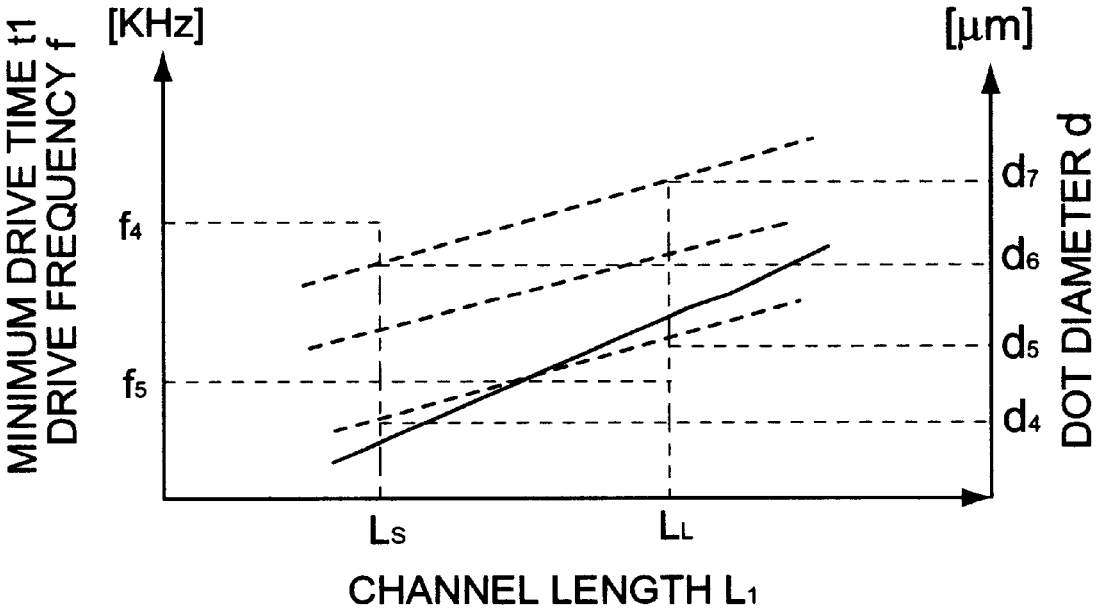
FIG. 20 illustrates the relationship among channel length, minimum drive time, drive frequency, and dot diameter in a sixth embodiment.
Figure 21:
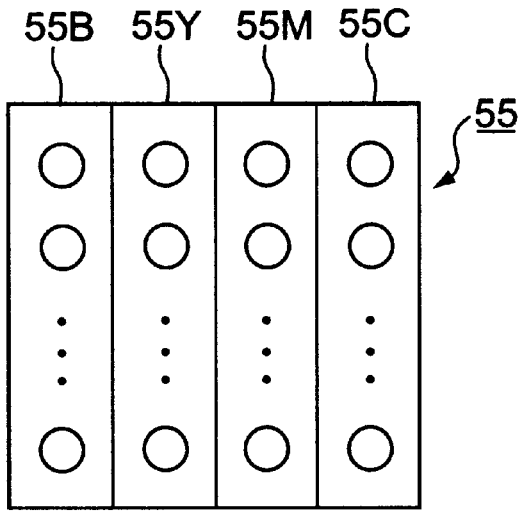
FIG. 21 shows a surface of an ink jet head in which orifices are formed.
Figure 21A:
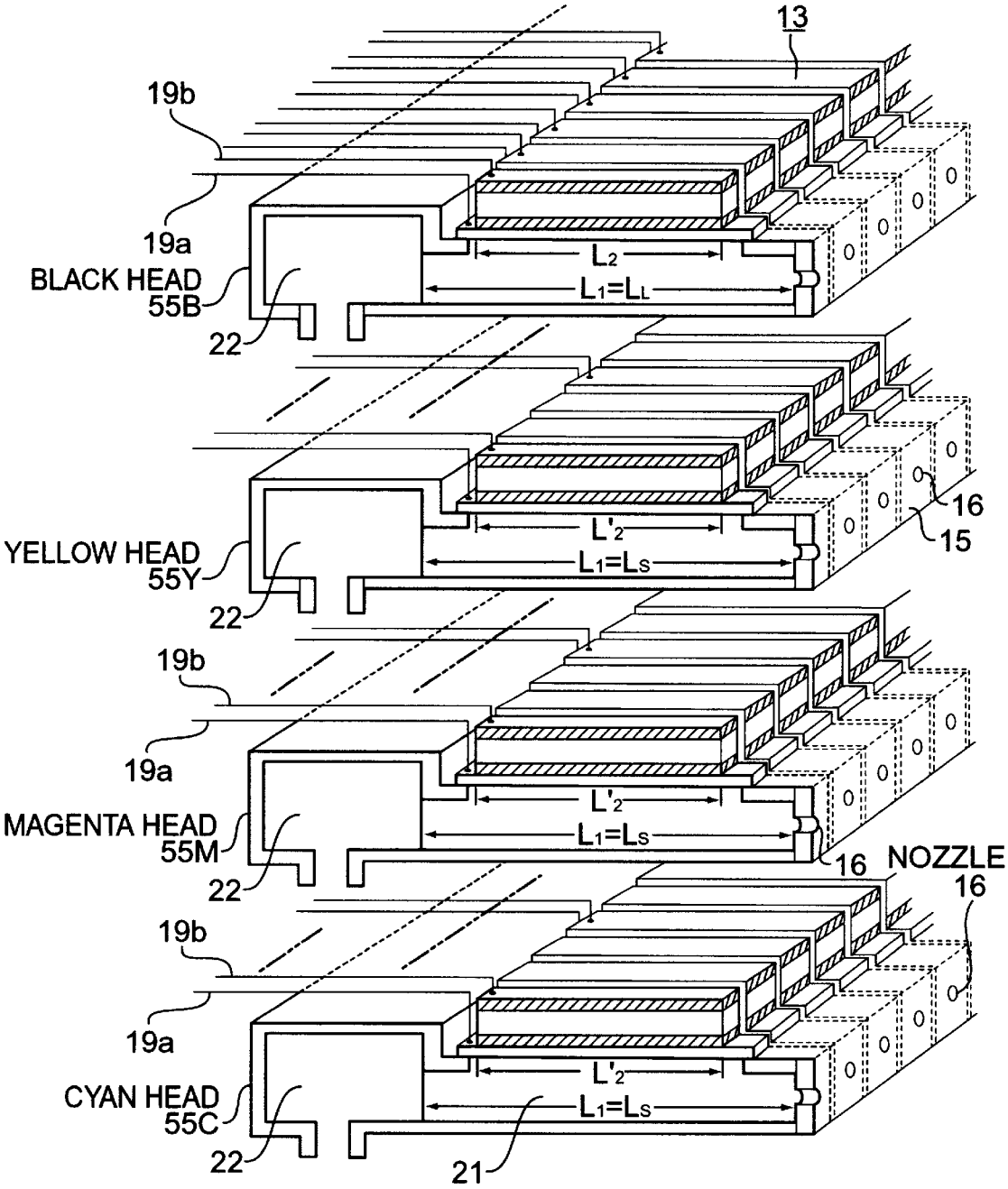
FIG. 21*a* is a perspective view of black, yellow, magenta and cyan heads stocked together, to form the ink jet head.

FIG. 20 illustrates the relationship among channel length L1, minimum drive time t1, drive frequency f, and dot diameter d in a sixth embodiment. FIG. 20 plots the channel length L1 of the channel 21 as abscissa and the minimum drive time length t1, drive frequency f, and dot d as ordinates. FIG. 21 shows a surface of an ink jet head 55 in which orifices are formed. FIG. 21*a* is a perspective view of black, yellow, magenta and cyan heads stocked together, to form the ink jet head.

Referring to FIG. 20, Curve Q3 shows the minimum drive time t1 versus the length L1 of the channel 21. Curve Q4 shows the drive frequency f versus the length L1. Curve Q5 shows the dot diameter d1 in the single drop method versus the length L1. Curve Q6 shows the dot diameter d2 in the single drop method versus the length L1. Curve Q7 shows the dot diameter d3 in the double drop method versus the length L1.

Just as in the first embodiment, the dot diameter is adjusted by changing the drive time of the piezoelectric element 13 and changing the number of ink (drops for each dot. When the length L1 of the channel 21 is changed, the dot diameter will change if the piezoelectric element 13 is driven for the same drive time length. In order to maintain the same dot diameter, the drive time must be changed and the drive frequency must be changed, accordingly. For example, we assume that characteristics shown in FIG. 10 are obtained for the length L1=$L_S$, then f1=f4=10 kHz f2=6.7 kHz f3=4.5 kHz d1=d4=30 μm d2=60 μm, and d3=d5=100 μm If the channel length L1 increases from $L_S$ to $L_L$, the drive frequency decreases as is clear from Curve Q4 and the dot diameter increases as is clear from Curves Q5, Q6, and Q7. Therefore, the drive frequency and dot diameter for L1=$L_L$ will be, for example, as follows:

f1=f5=8 kHz f2=5.4 kHz f3=3.6 kHz d1=d6=70 μm d2=100 μm, and d3=d7=140 μm In the sixth embodiment, the recording head takes the form of an ink jet head 55 which includes a black head 55B, yellow head 55Y, magenta head 55M, and cyan head 55C as shown of FIG. 21*a*. Black ink is used most often in printing characters and symbols. Therefore, the black printing operation is performed at a resolution of 300 dpi. Colored inks are used mostly when printing images such as photographs. Thus, the color printing operation is performed at a resolution of 600 dpi.

For this purpose, the black head 55B has a longer length L1 of the channel 21 than any of the yellow, magenta, rand cyan heads 55Y, 55M, and 55C. If the black head 55B has a length L1=$L_L$, then the diameter of black dot ranges from 70 to 140 μm. Thus, driving the piezoelectric element 13 in the single drop method provides the diameter d2 e.g., 100 μm) which is required when printing at a resolution of 300 dpi. The drive frequency is f2 e.g., 5.4 kHz) for L1=$L_L$ and f3 e.g., 4.5 kHz) for L1=$L_S$. It is to be noted that the drive frequency is higher when L1=$L_L$ than when L1=$L_S$. This implies that the black printing speed is higher when L1=$L_L$ than when L1=$L_S$.

The yellow, magenta, and cyan heads are designed to have the length L1=$L_S$ ($<L_L$). Thus, the diameter of the colored dot ranges from 30 to 100 μm, providing smaller dots suitable for higher resolution. However, the drive frequency is F3 e.g., 4.5 kHz) and the printing speed is lower accordingly.

As mentioned above, different frequencies are selected depending on whether the ink black dot or colored dot is formed. The black head 53B is driven at a higher drive frequency than yellow, magenta, and cyan heads, thereby preventing the black printing speed from significantly decreasing. The sixth embodiment may be combined with any one of the first, third, fourth, and fifth embodiments.

Seventh Embodiment

Figure 22:
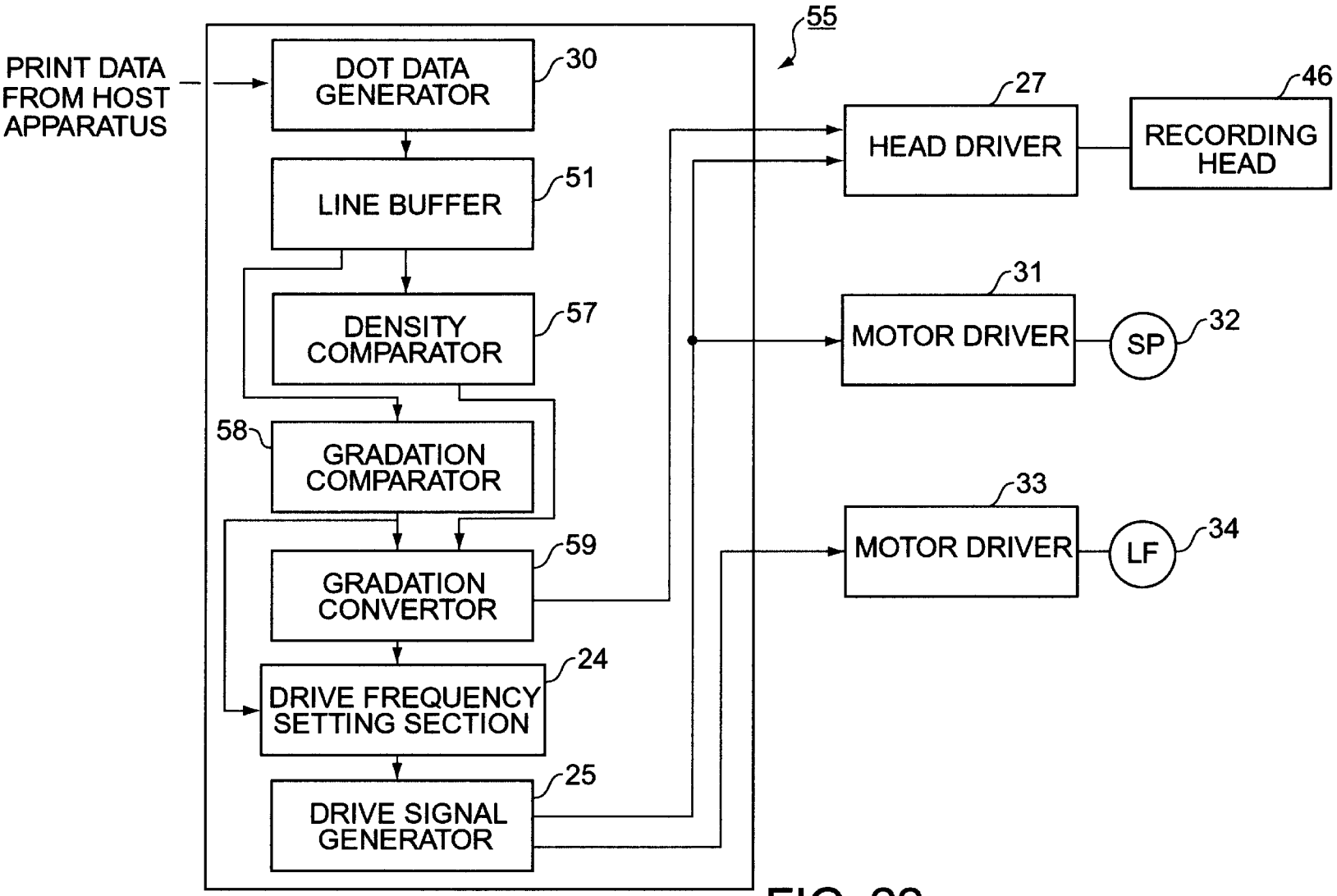
FIG. 22 illustrates a control block of a recording according to a seventh embodiment.
Figure 23:
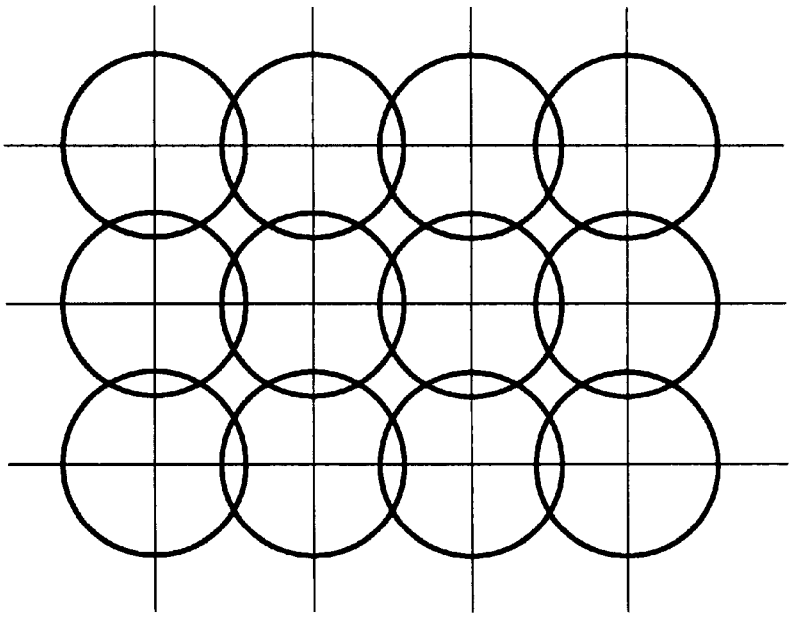
FIG. 23 shows a dot matrix before gradation levels are converted.
Figure 24:
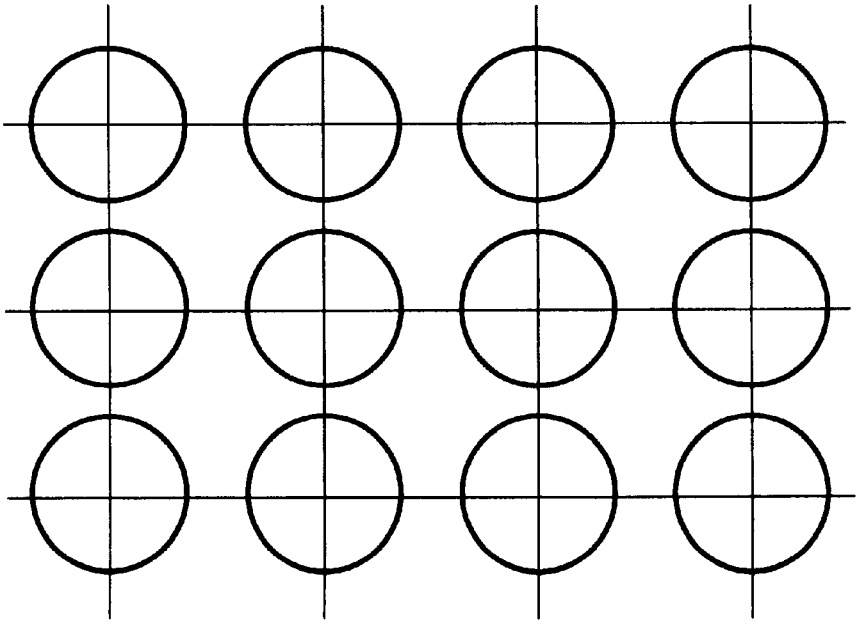
FIG. 24 shows a dot, matrix after the gradation levels are converted.

FIG. 22 illustrates a control block or a recording apparatus according to a seventh embodiment. FIG. 23 shows a dot matrix before the gradation level of print data is converted. FIG. 24 shows a dot matrix after the gradation level of the print data is converted. The same reference numerals have been given to elements similar to those in the fourth embodiment.

Referring to FIG. 22, a controller 56 controls the printing operation of the recording apparatus of the seventh embodiment. A dot data generator 30 receives print data from a lost apparatus, not shown, and generates dot data from the print data. A line buffer 51 receives the dot data for one or more lines from the dot data generator 30. A density comparator 57 performs an operation on the dot data stored in the buffer 51 to determine whether the dot density of the dot data is higher than a predetermined setting. A gradation level comparator 58 performs an operation on the dot data stored in the line buffer 51 to generate an average gradation level. The gradation level comparator 58 then checks the average gradation level to determine whether the average gradation level is higher than a predetermined setting (for example, the setting is 10 if the ink jet recording apparatus has 16 gradation levels.)

A gradation level converter 59 converts the gradation levels in accordance with the decisions made by the gradation level comparator 58 and the density comparator 57.

A drive frequency setting section 24 determines the drive frequency based on the decisions of the gradation comparator 58 and gradation level converter 59, and then generates a frequency setting signal. A drive signal generator 25 generates drive signal having drive times and timings. The timings are in timed relation with the drive frequency. The drive times are in accordance with the dot data and determine the sizes of dots to be printed on a print medium. Thus, when a dot density is higher than a predetermined setting and an average gradation level of the print data is higher than a predetermined setting, the gradation converter 59 lowers the gradation levels of all the dot data by, For example, 3, and sends the dot data having the decreased gradation level to the head driver 27. As a result, the dot matrix changes from that shown in FIG. 23 to that shown in FIG. 24. The drive frequency setting section 24 sets a higher drive frequency corresponding to a decrease in gradation level. In the seventh embodiment, if the dot density is higher than a predetermined setting and the average gradation level of the print data is higher than a predetermined setting, the gradation levels of all the dot data are converted. However, the gradation levels may be converted only for dot data having gradation levels higher than the predetermined setting.

As mentioned above, when the dot density is higher than a predetermined setting and the average gradation level of the dot data is higher than a predetermined setting, the gradation level is decreased and the drive frequency is increased. Thus, the printing speed is increased. If the embodiment is applied to an ink jet recording apparatus, a decrease in gradation level results in a decrease in ink drop size, preventing the print medium, not shown, from becoming wrinkled, and the ink from spreading or drying too slowly.

Eighth Embodiment

Figure 25:
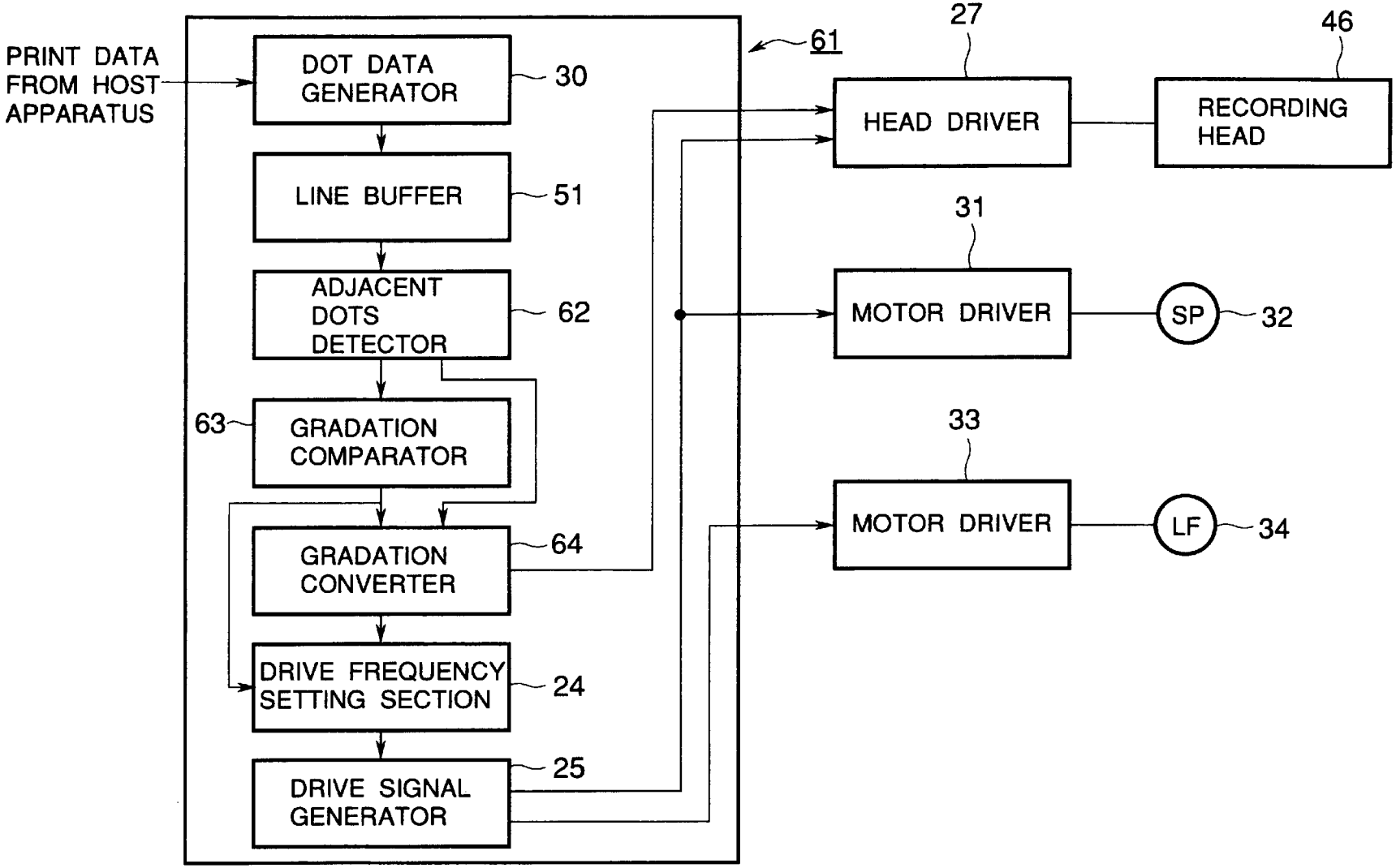
FIG. 25 is a control block of a recording apparatus according to an eighth embodiment.
Figure 26:
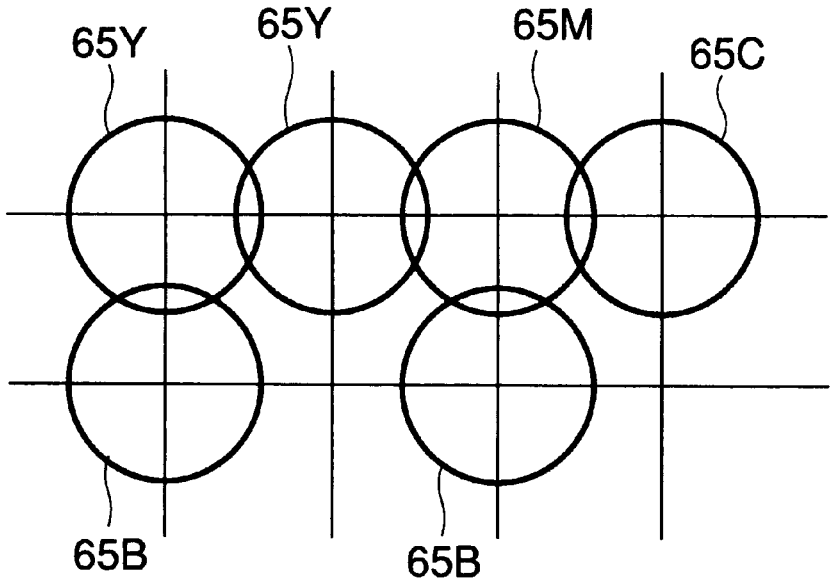
FIG. 26 illustrates a dot matrix before converting the gradation levels.
Figure 27:
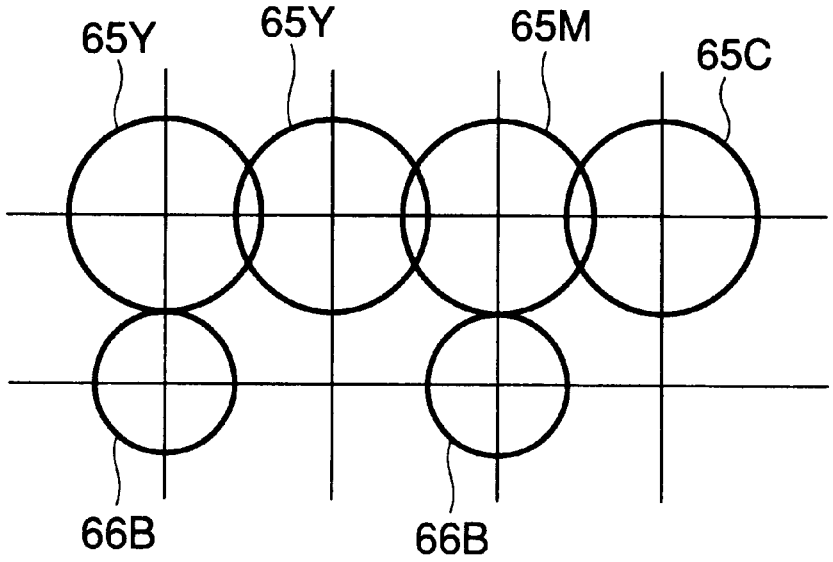
FIG. 27 shows a dot matrix after converting the gradation levels.

FIG. 25 is a control block of a recording apparatus according to an eighth embodiment. FIG. 26 illustrates a dot, matrix having black dots 65B, yellow dots 65Y, magenta dots 65M, and cyan dots 65C before the conversion of gradation levels. FIG. 27 shows a dot matrix having black dots 65B, yellow dots 65Y, magenta dots 65M, and cyan dots 65C after the conversion of gradation levels. The same reference numerals have been given to elements similar to those in the fourth embodiment.

Referring to FIG. 25, a controller 61 controls the printing operation of a recording apparatus of the eighth embodiment. A dot data generator 30 receives print data from a host apparatus, not shown, and generates dot data from the print data. A line buffer 51 receives dot data for a plurality of lines from the dot data generator 30. An adjacent-dot detector 62 checks the dot data stored in the line buffer 51 to determine whether adjacent dots are of different colors. In other words, a check is made to determine whether black dots are to be formed at a position next to colored dots. A gradation level comparator 63 performs an operation to find a gradation level of one of adjacent dots when the adjacent dots are a black dot and a colored dot, and then determines whether the gradation level is higher than a predetermined setting. A gradation level converter 64 converts the gradation level of the dot, e.g., black dot, having a gradation level higher than the predetermined setting, in accordance with the decisions of the adjacent-dot detector 62 and gradation level comparator 63. If it is determined that the one of the adjacent dots has a gradation level less than the predetermined setting, then the gradation level comparator 63 performs an operation to find a gradation level of the other of the adjacent dots. Then, the gradation level converter 64 converts the gradation level of the dot if the dot has a gradation level higher than the predetermined setting.

A drive frequency setting section 24 determines a drive frequency from the decisions made by the gradation level Comparator 63 and gradation level converter 64, and outputs a frequency setting signal. A drive signal generator 25 generates a drive signal having drive times and timings. The timings are in timed relation with the drive frequency. The drive times are in accordance with the dot data and determine the sizes of dots to be printed on a print medium.

When black dot is to be formed adjacent other colored dots and has a gradation level higher than a predetermined setting, the gradation level converter 64 converts the gradation level or the black dot to a lower level, and sends the dot data having the lower gradation level to the recording head 46 via the head driver 27.

As a result, dots printed on the print medium are those shown in FIG. 27 rather than those shown in FIG. 26. It is to be noted that the black dots 66B adjacent the colored dots 65Y and 65M are smaller than the colored dots after the conversion of gradation level and therefore the black dots 66B do not overlap the adjacent colored dots.

The drive frequency setting section 24 sets a higher drive frequency corresponding to a decrease in the gradation level of the black dots 65B.

While the embodiment has been described with reference to the lowering of gradation level of the black dots 65B, the gradation levels of the yellow dots 65Y, magenta dots 65M, and cyan dots (65C may be decreased instead. Still alternatively, the gradations of all of the dots may be decreased.

When the embodiment is applied to an ink jet recording apparatus, ink drop size becomes smaller with decreasing gradation level, preventing the print medium from becoming wrinkled and the ink from spreading and drying too slowly. Moreover, the black ink drop is not mixed with the colored dots and therefore increasing print quality.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A recording apparatus, comprising:

a dot data generator, generating dot data from print data and outputting the dot data;

a drive frequency setting section, setting a drive frequency in accordance with a print condition;

a drive signal generator, generating a drive signal having drive times and timings, the drive times being changed in accordance with the dot data and the timings being in timed relation with the drive frequency;

a recording head driven by the drive signal to form a plurality of dots on a print medium in accordance with the dot data, the dots having different diameters in accordance with the drive times;

a gradation level converter for changing a gradation level of the dot data;

a density comparator for determining whether a dot density of the dot data is higher than a predetermined setting of density; and a gradation level comparator for determining whether an average gradation level of the dot data is higher than a predetermined setting of gradation level;

wherein said gradation level converter changes a gradation level of the dot data if the dot density is higher than the predetermined setting of density and the average gradation level is higher than the predetermined setting of gradation level.

2. The recording apparatus according to claim 1, wherein said gradation converter changes a gradation level of a dot to a lower gradation level.

3. The recording apparatus according to claim 1, wherein the drive frequency is determined according to the gradation level of the dot data that has been changed by said gradation level converter.

4. A recording apparatus, comprising:

a dot data generator, generating dot data from print data and outputting the dot data;

a drive frequency setting section, setting a drive frequency in accordance with a print condition;

a drive signal generator, generating a drive signal having drive times and timings, the drive times being changed in accordance with the dot data and the timings being in timed relation with the drive frequency;

a recording head driven by the drive signal to form a plurality of dots on a print medium in accordance with the dot data, the dots having different diameters in accordance with the drive times;

a gradation level converter for changing a gradation level of the dot data; and a gradation level comparator determining whether an average gradation level of the dot data is higher than a predetermined setting of gradation level, wherein said gradation level converter changes the gradation level of the dot data if the average gradation level is higher than a predetermined setting of gradation level.

5. The recording apparatus according to claim 4, wherein said gradation converter changes a gradation level of a dot to a lower gradation level.

6. The recording apparatus according to claim 4, wherein the drive frequency is determined according to the gradation level of the dot data that has been changed by said gradation level converter.

7. A recording apparatus, comprising:

a dot data generator, generating dot data from print data and outputting the dot data;

a drive frequency setting section, setting a drive frequency in accordance with a print condition;

a drive signal generator, generating a drive signal having drive times and timings, the drive times being changed in accordance with the dot data and the timings being in timed relation with the drive frequency;

a recording head driven by the drive signal to form a plurality of dots on a print medium in accordance with the dot data, the dots having different diameters in accordance with the drive times; and a gradation level converter for changing a gradation level of the dot data, wherein said gradation converter changes a gradation level of at least one of the adjacent dots if the adjacent dots in the dot data are of different colors and at least one of the adjacent dots has a gradation level higher than a predetermined setting.

8. The recording apparatus according to claim 7, wherein said gradation converter changes a gradation level of a dot to a lower gradation level if the dot has a gradation level higher than the predetermined setting.

9. The recording apparatus according to claim 7, further comprising an adjacent dot detector for determining whether adjacent dots are of different colors.

10. The recording apparatus according to claim 7, wherein said gradation converter changes gradation levels of the adjacent dots to lower gradation levels.

11. The recording apparatus according to claim 7, wherein said drive frequency setting section sets the drive frequency in accordance with the changed gradation level.

12. The recording apparatus according to claim 7, further comprising a gradation comparator for determining whether at least one of the adjacent dots has a gradation level higher than a predetermined setting.

13. A recording apparatus, comprising:

a dot data generator, generating dot data from print data and outputting the dot data;

a drive frequency setting section, setting a drive frequency in accordance with a print condition;

a drive signal generator, generating a drive signal having drive times and timings, the drive times being changed in accordance with the dot data and the timings being in timed relation to the drive frequency; and an ink jet head driven by the drive signal to form a plurality of dots on a print medium in accordance with the dot data, said ink jet head including a first channel holding ink of a first type therein and having a first corresponding orifice, said first channel being driven when the ink jet head is forming larger dots, and at least one second channel having a second corresponding orifice and holding ink of a second type different than the first type therein, and being driven when the ink jet head is forming smaller dots, the first channel having a longer channel length than the second channel;

wherein said drive frequency setting section sets a higher drive frequency for said first channel than for said second channel.

14. The recording apparatus according to claim 13, wherein said first channel has a first diaphragm that causes ink drops to be ejected from said first channel, and said second channel has a second diaphragm that causes ink drops to be ejected from said second channel, said first channel having a longer diaphragm than said second channel.

15. The recording apparatus according to claim 13, wherein the first type ink is black ink and the second type ink is a colored ink.

* * * * *